US005715965A

United States Patent [19]

Goulding

[11] Patent Number: 5,715,965

[45] Date of Patent: Feb. 10, 1998

[54] HATCH SEAL

[75] Inventor: Grahame James Goulding, Bringelly, Australia

[73] Assignee: Anti-Spill Technology PTY. Limited, New South Wales, Australia

[21] Appl. No.: 411,764

[22] PCT Filed: Sep. 30, 1993

[86] PCT No.: PCT/AU93/00506

§ 371 Date: May 17, 1995

§ 102(e) Date: May 17, 1995

[87] PCT Pub. No.: WO94/07772

PCT Pub. Date: Apr. 14, 1994

[30] Foreign Application Priority Data

Oct. 1, 1992 [AU] Australia ..... PL5070

[51] Int. Cl.[6] ..... B65D 45/34

[52] U.S. Cl. ..... 220/321; 220/562; 220/DIG. 24; 220/DIG. 20; 105/377.11; 105/377.01; 292/256.65; 292/DIG. 11

[58] Field of Search ..... 220/320, 321, 220/724, 725, DIG. 20, 319, 562, DIG. 24, 88.1; 215/274, 275; 137/347, 350, 377, 382; 52/19, 20; 292/DIG. 11, 256.5, 256.6, 256.65, 256.67, 256.69; 105/377.01, 377.08, 377.11

[56] References Cited

U.S. PATENT DOCUMENTS

| | | | |
|---|---|---|---|
| 2,133,060 | 10/1938 | Stephens | 220/321 X |
| 2,237,310 | 4/1941 | Norbom | 220/DIG. 24 X |
| 2,553,220 | 5/1951 | Troeger | 220/320 X |
| 2,703,188 | 3/1955 | Blanchette et al. | 220/321 |
| 3,239,175 | 3/1966 | Seibel . | |
| 3,561,637 | 2/1971 | McConnell . | |
| 3,854,623 | 12/1974 | Pierson | 137/382 X |
| 4,098,428 | 7/1978 | Taniguchi | 220/319 |
| 4,373,547 | 2/1983 | Geis et al. | 137/377 |
| 4,478,345 | 10/1984 | Edinger | 220/320 X |
| 4,699,294 | 10/1987 | Carlin, Jr. | 220/319 X |
| 4,732,294 | 3/1988 | Bohler . | |
| 5,011,038 | 4/1991 | Schultz . | |
| 5,111,955 | 5/1992 | Baker et al. | 220/203.01 X |
| 5,411,162 | 5/1995 | Koziczkowski et al. | 220/321 X |

FOREIGN PATENT DOCUMENTS

| | | | |
|---|---|---|---|
| 143760 | 10/1951 | Australia | 220/321 |
| 36468 | 11/1978 | Australia . | |
| 36468 | 11/1979 | Australia . | |
| 2355 | 9/1984 | Australia . | |
| 23558 | 9/1984 | Australia . | |
| 33445 | 9/1987 | Australia . | |
| 501555 | 4/1954 | Canada | 220/320 |

(List continued on next page.)

OTHER PUBLICATIONS

Derwent Abstract Accession No. 86–142631/22 Class Q33, SU, A, 1188055(Sokolov) Oct. 30, 1985.

Derwent Abstract Accession No. 92–306159/37 Class Q34, SU,A,1684178(Azovmash) Oct. 15, 1991.

(List continued on next page.)

*Primary Examiner*—Stephen P. Garbe
*Assistant Examiner*—Nathan Newhouse
*Attorney, Agent, or Firm*—Ladas & Parry

[57] ABSTRACT

A hatch in road or rail tanker (2) includes a hatch cover (7) mounted in a flange (8) of a compartment manhole (9). In order to prevent leaks from the hatch cover (7), a band (13) is welded to the top of the tank (2) around compartment manhole (9). The band (13) includes an outwardly concave flange (14) providing a groove for receiving a hatch sealing device (15). The hatch sealing device (15) includes a generally cylindrical rubber cylinder having an open end and a closed end closed by a seal membrane, also of rubber. Around the inside of the rim forming open end there is provided an internally extending lip shaped to fit into concave flange (14). Around the outside of the cylinder is provided a split ring of metal, the ends of which are drawn together in order to radially compress the cylinder and thus seal it around the flange (14).

12 Claims, 4 Drawing Sheets

FOREIGN PATENT DOCUMENTS

| | | | |
|---|---|---|---|
| 385860 | 9/1990 | European Pat. Off. . | |
| 532218 | 9/1921 | France . | |
| 569904 | 1/1924 | France . | |
| 2640376 | 6/1990 | France . | |
| 3042547 | 6/1981 | Germany . | |
| 369328 | 4/1973 | U.S.S.R. | 137/382 |
| 1188055 | 10/1985 | U.S.S.R. . | |
| 1684178 | 10/1991 | U.S.S.R. . | |
| 8908594 | 9/1989 | WIPO . | |

OTHER PUBLICATIONS

Derwent Abstract Accession No. F6770 D/2S DE 3042–547 (Koloseus) Jun. 11, 1981.

Derwent Abstract Accession No. 90–233373/31 FR 2640–376 A Jun. 15, 1990.

Derwent Abstract Accession No. 86–142631/22, Class Q33, SU.A, 1188055 (Sokolov) 30 Oct. 1985.

Derwent Abstract Accession No. 92–306159/37, Class Q34, SU.A, 1684178 (Azovmash) 15 Oct. 1991.

HATCH SEAL

BACKGROUND OF THE INVENTION

This invention relates to sealing devices, and particularly to a device for sealing a hatch of the type provided in tankers, submarines, etc.

As is well known, such hatches are prone to leaking. For example, in road and rail tankers, the or each hatch provided at the top of the tanker comprises a compartment hatch cover which fits over the compartment manhole. The hatch cover is provided with a number of features including a pressure vacuum vent, a dip tube, and an inspection hatch. Although it will be apparent that leaks could occur at each of the features in the hatch cover, as well as the edge of the hatch cover itself, when there is an accident such as the tanker rolling over, such leaks even occur when the tanker is normally parked on an incline.

BRIEF SUMMARY OF THE INVENTION

It is therefore an object of the present invention to provide a sealing device for a hatch which can be positioned around a leaking hatch to prevent, or at least reduce leakage.

Accordingly, the invention provides a sealing device for a hatch, the sealing device comprising a generally cylindrical member having an open end for fitting around the hatch, said member having its other end closed in a fluid-tight manner, and means for maintaining the cylindrical member in radial compression against a flange provided around the hatch to seal said cylindrical member to said flange.

The flange could be a flange on a wall supporting the hatch cover, or could be a separate flange attached, for example by welding, around the hatch.

In a preferred embodiment, the means for maintaining the cylindrical member in compression comprises a split band arranged around the cylindrical member and having means for pulling the two ends of the split band together so as to tighten the band around the cylindrical member. Preferably, the means for pulling the two ends together comprises a tongue attached to one of the ends and a lever rotatably mounted to the other of the ends and biased against the tongue, whereby, when the lever is rotated, the tongue is biased thus moving the one of the ends towards the other of the ends.

Preferably, the tongue slides within a guide in the other of the ends and is provided with a flange, through which extends a longitudinal member, biases against the flange and coupled to the lever at a point adjacent the rotational axis of the lever. The longitudinal member is preferably provided with means for adjusting the bias of the member.

In one embodiment, the open end of the member is provided with a lip around the rim thereof, the lip being adapted for fitting to a groove in the flange around the hatch.

In another embodiment, the open end of the member can be fitted over a flange having a ridge therearound for compressing over the ridge.

According to a second aspect, the invention provides a substantially cylindrical band for permanently attaching around a hatch in a surface of, for example, a road or rail tanker or a submarine, the cylindrical band having a flange to which the hatch sealing device as described above can be sealed.

The flange can be provided with a ridge or a groove to which the member described above can be sealed.

According to a third aspect, the invention provides a road or rail tanker having one or more cylindrical bands of the type described above permanently attached thereto. The sealing device includes an annular spacing assembly, said annular spacing assembly having an internal diameter sized to engage the outermost surface of the hatch and an external diameter sized to engage the innermost surface of the generally cylindrical member, wherein said assembly is compressible by the means for radially compressing the generally cylindrical member.

In a fourth aspect, the invention provides a flange comprising a substantially annular member for fitting around a hatch in a surface of, for example, a road or rail tanker or a submarine, the annular member having sealing means around the internal diameter thereof for sealing to an upstanding wall of the hatch and being compressible by a hatch sealing device as described above.

Preferably, the annular spacing member is formed in at least two segments to facilitate fitting the annular member around the hatch. Preferably, sealing means are provided between the contact faces of the segments, as well as around the internal diameter of the annular member. The annular member can be of metal, plastics or rubber material.

In a fifth aspect, the invention provides a hatch sealing apparatus comprising a hatch sealing device as described above, in combination with the flange formed by the annular member as described above.

BRIEF DESCRIPTION OF THE DRAWINGS

Embodiments of hatch sealing devices and apparatus according to the invention will now be more fully described, by way of example, with reference to the drawings, of which.

DETAILED DESCRIPTION OF THE DRAWINGS

Figure 1:
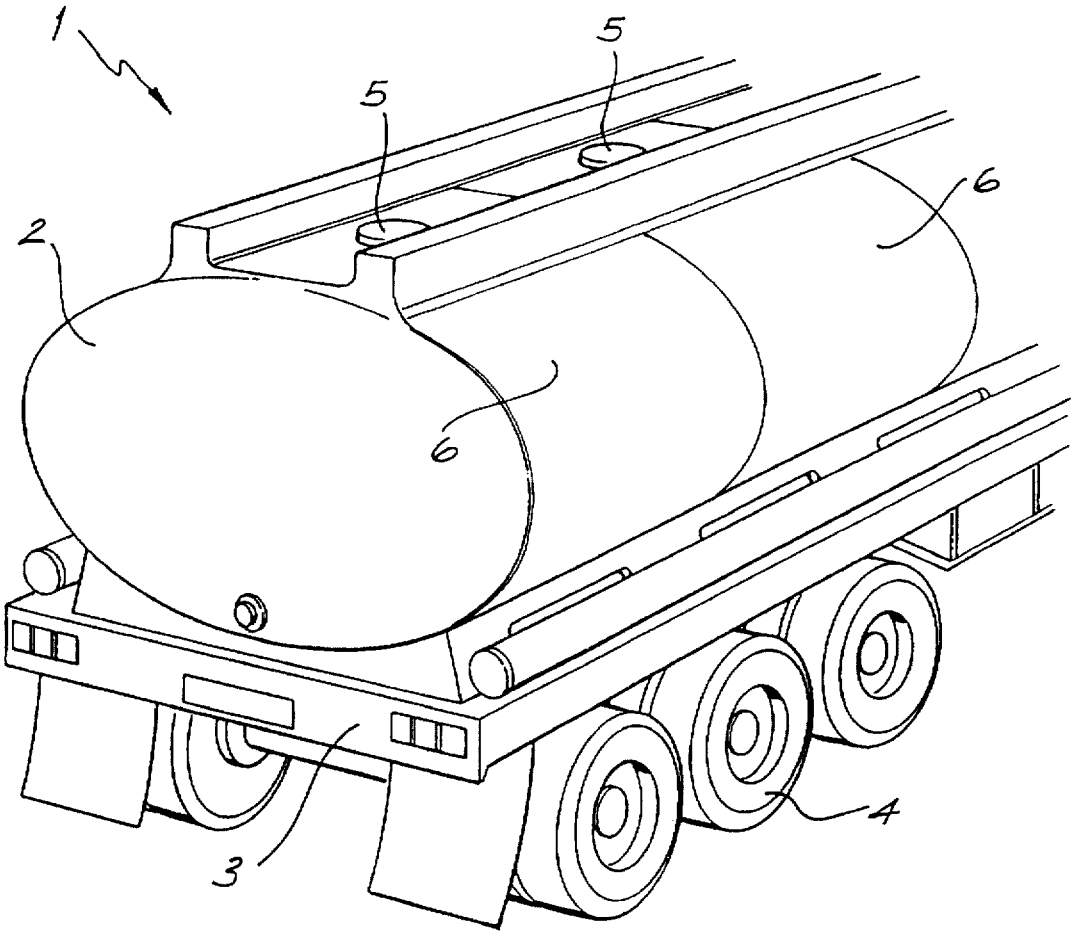
FIG. 1 is a schematic view of the rear portion of a conventional road tanker.

Thus, as shown in FIG. 1, a conventional road tanker 1 including a tank 2 mounted on a chassis 3 supported by wheels 4 is provided with a plurality of compartment hatches 5 along the top of the tank 2 to provide access to the plurality of tank compartments 6 forming the tank 2.

Figure 2:
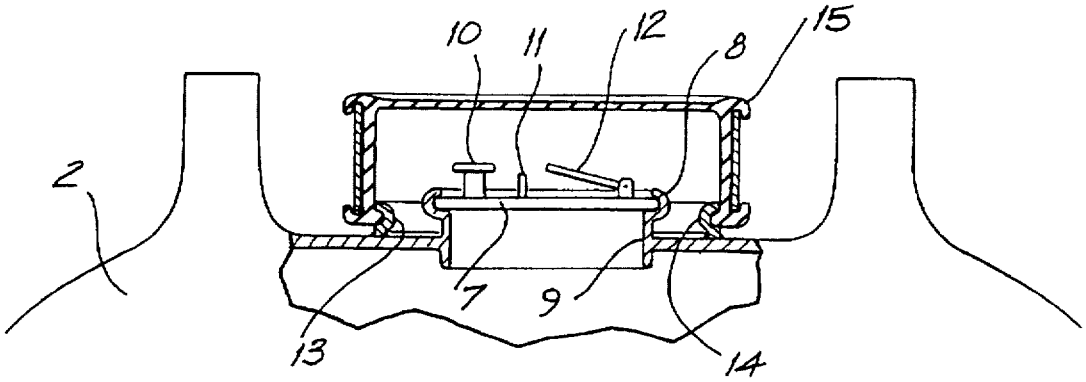
FIG. 2 is a schematic cross-sectional view of a hatch in the tanker of FIG. 1 with a hatch sealing device according to one embodiment of the invention in position.

As shown in more detail in FIG. 2, the compartment hatch 5 includes a hatch cover 7 mounted in a flange 8 of a compartment manhole 9. The hatch cover 7 is provided with a pressure vacuum vent 10, a dip tube 11 and a loading/inspection hatch 12, which is hingedly mounted to the cover 7. As mentioned above, leakage of fluid from the tank 2 can occur at flange 8 if the cover 7 is not properly sealed thereto, from pressure vacuum vent 10 and dip tube 11, if they are not properly sealed and from loading/inspection hatch 12 if it is not properly sealed to cover 7. Such leaks are especially likely in the event of an accident where the tanker is rolled over. However, it has been known for leaks to occur even when the tanker is upright but parked on an incline.

Thus, in one embodiment of the invention, a cylindrical band 13 is welded to the top of the tank 2 around compartment manhole 9. The band 13 includes an outwardly concave flange 14 providing a groove for receiving a hatch seal 15.

Figure 3:
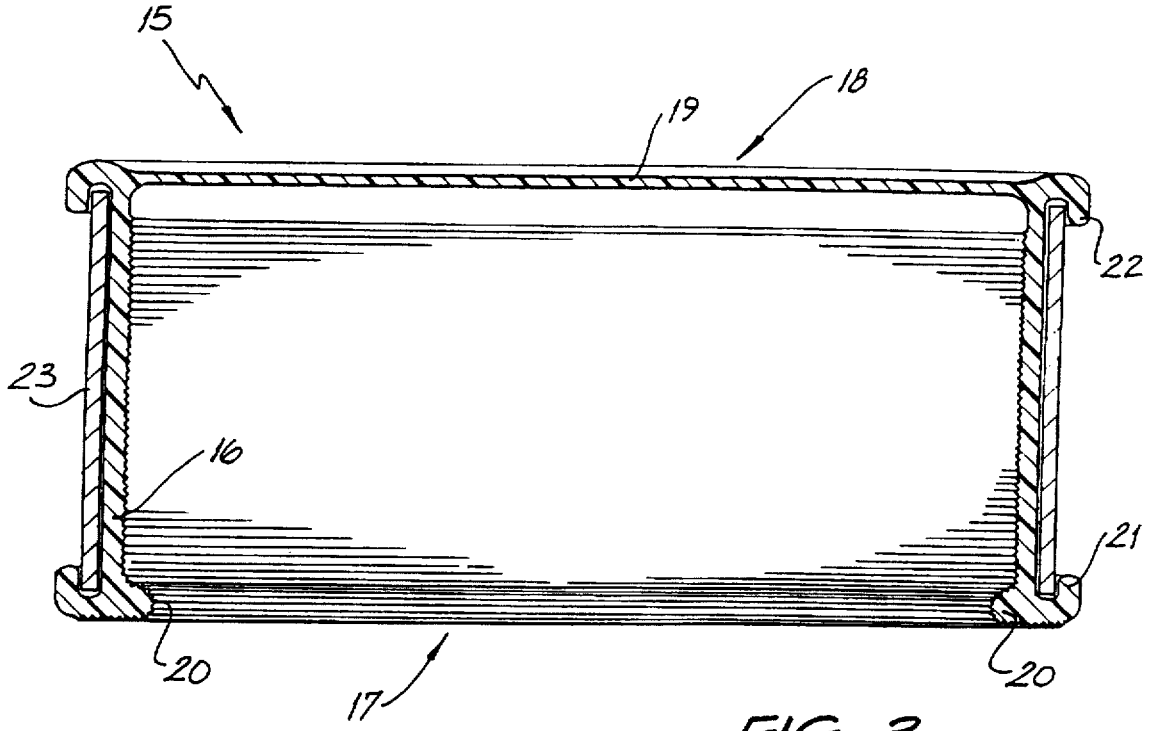
FIG. 3 is a cross-sectional view of the hatch sealing device shown in FIG. 2.

As more clearly shown in FIG. 3, the hatch sealing device 15 comprises a generally cylindrical member 16 formed of rubber. The member 16 has an open end 17 and a closed end 18 closed by a seal membrane 19, also of rubber. Around the inside of the rim forming open end 17 there is provided an internally extending lip 20 shaped to fit into concave flange 14 of band 13. On the outside of both open end 17 and closed end 18, there are provided clip portions 21 and 22, respectively, between which is retained a split ring 23 of metal. The internal sides of cylindrical member 16 and lip 20 are preferably fluted, as shown, in order to reduce the amount of pressure required to radially compress the cylindrical member 16.

Figure 4:
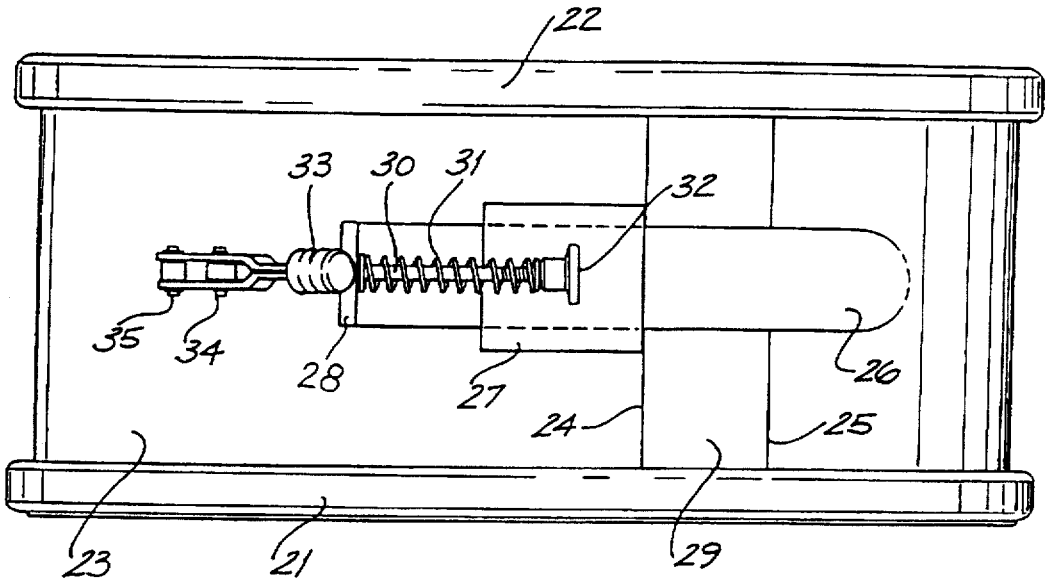
FIG. 4 is a side view of the hatch sealing device shown in FIG. 3 showing the compression means.
Figure 5:
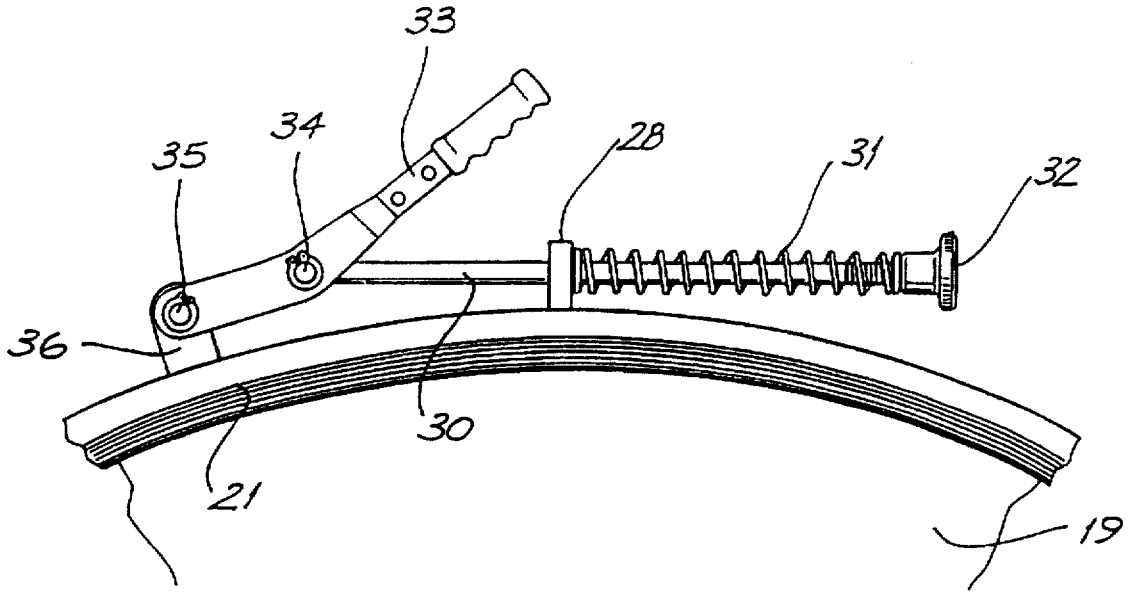
FIG. 5 is a partial end view of the hatch sealing device shown in FIG. 3 with the compression means in position.

The compression is carried out by drawing together the two ends 24 and 25 of split ring 23. As best shown in FIGS. 4 and 5, the ends 24 and 25 of split ring 23 are drawn together by a lever and tongue arrangement. A tongue 26 is welded to end 25 of split ring 23 and slidably passes through a guide 27 in end 24 of split ring 23. The end of the tongue 26 opposite to that welded to end 25 of split ring 23 is provided with a tongue flange 28. A sealing plate 29 is welded to the inner side of split ring 23 at its end 25 and extends below end 24 of split ring 23 which slidably passes over sealing plate 29.

An elongate bar 30 passes through an aperture in tongue flange 28 and is provided with a compression spring 31 coiled around the member 30 between tongue flange 28 and an end stop 32 threaded on one end of member 30 so as to be able to adjust the bias of compression spring 31. The other end of elongate member 30 is pivotably coupled to a lever arm 33 at pivot 34. The lever arm 33 is itself pivotally mounted at 35 to mount 36 attached to split ring 23. The pivots 34 and 35 are spaced from each other so that, when lever 33 is pivoted about pivot 35, elongate member 30 is pulled against the bias of compression spring 31, which biases tongue flange 28 such that ends 24 and 25 of split ring 23 are pulled together. This compresses, and maintains in compression, the cylindrical member 16 so as to tighten lip 20 within concave flange 14, and thus seal the cylindrical member 16 around the hatch.

Figure 6:
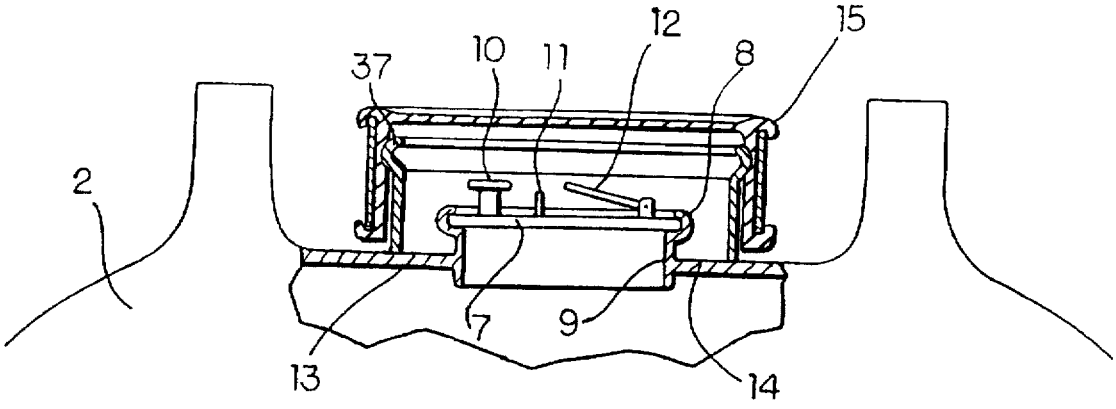
FIG. 6 is a schematic cross-sectional view similar to that of FIG. 2 with a hatch sealing device according to a second embodiment of the invention in position.

Turning now to FIG. 6, there is shown a second embodiment, similar to the first embodiment, in which all identical elements have the same reference numerals. As can be seen, in this embodiment, the lip 20 around the open end of the member 16 is not present. In this embodiment it is not required since the band 13 is taller than that of the first embodiment, and is provided with a convex flange 37 forming a ridge at an upper portion thereof. The hatch seal 15 is thus positioned over the flange 37 and compressed over the flange 37 to seal around it.

In an alternative to this embodiment, the hatch seal 15 could be compressed directly onto the flange 8 of manhole compartment 9 if the leakage occurs from the top of the hatch cover rather than from the lower portions of manhole compartment 9.

Figure 7:
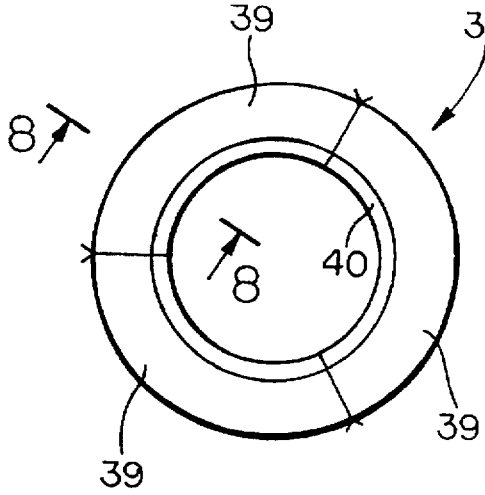
FIG. 7 is a plan view of a flange forming part of a third embodiment of a hatch sealing device according to the invention.
Figure 8:
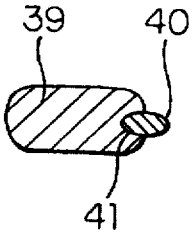
FIG. 8 is a cross-sectional view of the flange of FIG. 7 along line VIII—VIII.
Figure 9:
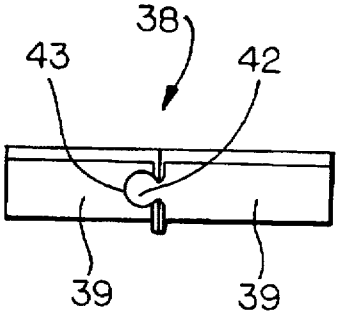
FIG. 9 is a cross-sectional view through a part of the flange of FIG. 7 looking from above.
Figure 10:
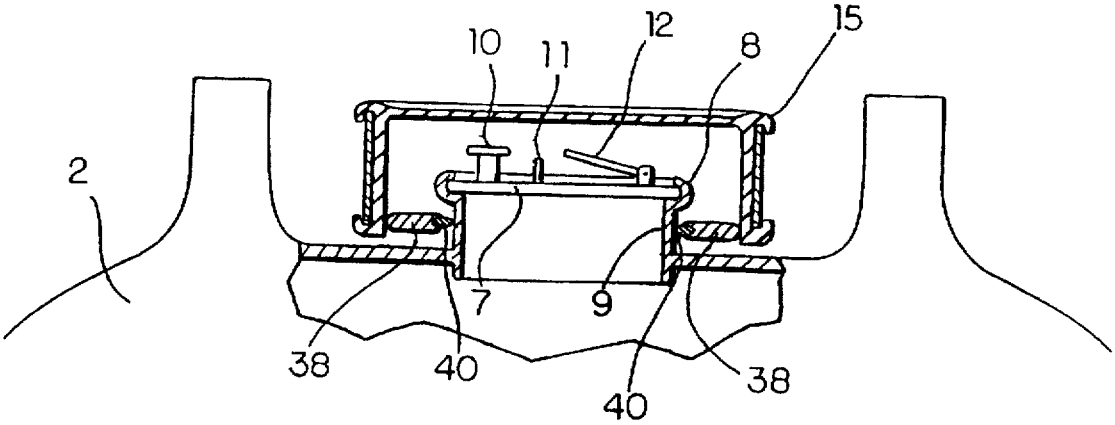
FIG. 10 is a schematic cross-sectional view similar to that of FIG. 2 with a hatch sealing device according to a third embodiment of the invention including the flange of FIGS. 7, 8 and 9 in position.

Shown in FIG. 10 is a still further embodiment of the invention, again with the same elements having the same reference numerals as in the earlier embodiments. In this embodiment the member 16 again does not have the lip 20 around its open end, and the hatch seal is generally identical to the hatch seal of the second embodiment. However, in this embodiment, the band 13 is not present. Instead, there is provided a annular spacing assembly 38 formed of three segmented annular spacing members 39 and having a sealing element 40 extending around the inner side thereof. The annular spacing assembly 38 is more clearly shown in FIGS. 7, 8 and 9. The annular members 39 can be made of any suitable material, such as metal, plastics or rubber material and has a groove 41 around the inner side thereof into which the sealing element 40 is fitted. Of course, if the annular member is itself made of a material which will provide adequate sealing, a separate sealing element would not be required. As shown in FIG. 9, which is a part cross-sectional view looking from above the view of FIG. 7, the three segments forming the annular member 39 are joined together at their contact faces by means of a tongue 42 and recess 43 arrangement. The sealing element 40 is arranged to seal the contact faces when they are connected.

To use the hatch seal, the annular member 39 is disconnected into its three members 39 and positioned around the outside of the wall of manhole compartment 9 and then connected together such that the sealing element 40 is positioned between the contact faces of the annular member 39 and around the inner side thereof adjacent the wall of manhole compartment 9. The hatch seal 15 is then positioned over the spacing assembly 38 formed by the three annular spacing members 39 and the sealing element 40 and radially compressed in the manner described above. Radial compression causes the members 39 of the assembly 38 to be tightly connected with the sealing element 40 sealing the contact faces and forming a tight seal between the inner side of the assembly 38 and the wall of the manhole compartment 9.

It will be appreciated, that although only particular embodiments of the hatch seal and the way of compressing the cylindrical member have been described, various modifications and improvements can be made without departing from the scope of the present invention.

For example, it will be appreciated that if the ring 13 is used, it should be made of a material compatible with that of the tank to which it is attached, for example by welding.

The split ring 23 should be made of material resistant to the fluid in the tank, for example of stainless steel.

Furthermore, the cylindrical member, and the annular member forming the flange, if used, can be formed of any material which is substantially impervious and/or resistant to fluid within the tank.

I claim:

1. A combination of a sealing device and hatch comprising the hatch having a base and neck extending upwardly from said base forming a passage way closed by a cover; a flange spaced radially from the neck and extending upwardly from the base; the sealing device having a generally cylindrical member with an open end fitting around the flange, said cylindrical member having its other end closed in a fluid tight manner; and means for radially compressing the cylindrical member and maintaining the cylindrical member in radial compression against the flange to seal said cylindrical member to the flange.

2. The combination according to claim 1 wherein said means for radially compressing the cylindrical member and maintaining the cylindrical member in compression comprises a split band arranged around the cylindrical member and having means for pulling the two ends of the split band together so as to tighten the split band around the cylindrical member.

3. The combination according to claim 2 wherein said means for pulling the two ends together comprises a tongue attached to one of the ends and a lever rotatably mounted to the other of the ends and biased against the tongue, whereby, when the lever is rotated, the tongue is biased thus moving the one of the ends towards the other of the ends.

4. The combination according to claim 3 wherein said tongue slides within a guide in the other of the ends and is provided with a tongue flange, through which extends a longitudinal member biased against the flange and coupled to the lever at a point adjacent the rotational axis of the lever.

5. The combination according to claim 4 wherein said longitudinal member is provided with means for adjusting the bias of the member.

6. The combination according to claim 2 wherein said split band is steel.

7. The combination according to claim 1 wherein said cylindrical member is formed of material which is substantially impervious and/or resistant to fluid within the hatch.

8. The combination according to claim 1 wherein the open end of the member is provided with a lip around the rim thereof, the lip being sized to engage a groove in the flange surrounding the hatch.

9. The combination according to claim 1 including an annular spacing assembly, said annular spacing assembly having an internal diameter sized to engage the outermost surface of the hatch and an external diameter sized to engage the innermost surface of the generally cylindrical member, wherein said assembly is compressible by the means for radially compressing the generally cylindrical member.

10. The combination as claimed in claim 9 wherein said annular spacing assembly is comprised of at least two segments, said segments being lockable to each other by complementary engaging formations.

11. The combination as claimed in claim 10 wherein said complementary engaging formations are tongue and groove formations provided in adjacent segments.

12. The combination as claimed in claim 9 wherein said annular spacing assembly includes an inwardly facing annular sealing element.

* * * * *